US007156483B2

(12) United States Patent
King et al.

(10) Patent No.: US 7,156,483 B2
(45) **Date of Patent: *Jan. 2, 2007**

(54) METHOD FOR DETERMINING INK DROP VELOCITY OF CARRIER-MOUNTED PRINTHEAD USING AN OPTICAL SCANNER

(75) Inventors: David G. King, Shelbyville, KY (US); Patrick L. Kroger, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 292 days.

This patent is subject to a terminal disclaimer.

(21) Appl. No.: 10/860,209

(22) Filed: Jun. 3, 2004

(65) Prior Publication Data

US 2005/0270324 A1 Dec. 8, 2005

(51) Int. Cl.
*B41J 29/393* (2006.01)

(52) U.S. Cl. ..... 347/19; 347/8; 347/9

(58) Field of Classification Search ..... 347/5, 347/8–9, 12, 19, 14, 56
See application file for complete search history.

(56) References Cited

U.S. PATENT DOCUMENTS 6,530,640 B1 3/2003 Vega et al. ..... 347/19
6,629,747 B1 10/2003 King et al. ..... 347/19
6,631,971 B1 10/2003 Adkins et al. ..... 347/19
6,637,853 B1 * 10/2003 Ahne et al. ..... 347/19
6,669,324 B1 12/2003 King et al. ..... 347/19
6,883,892 B1 * 4/2005 Sievert et al. ..... 347/19
2002/0089561 A1 7/2002 Weitzel et al. ..... 347/19
2003/0043221 A1 3/2003 Vega et al. ..... 347/19
2003/0081040 A1 5/2003 Therien et al. ..... 347/19
2003/0122886 A1 7/2003 Adkins et al. ..... 347/19

* cited by examiner

*Primary Examiner*—Stephen Meier
*Assistant Examiner*—Lam S. Nguyen
(74) *Attorney, Agent, or Firm*—Douglas E. Erickson

(57) ABSTRACT

A method for determining ink drop velocity of a printhead located at a gap above a print medium. A first ink mark is printed at a first printhead velocity. A second ink mark is printed at a different (in magnitude and/or direction) second printhead velocity. The ink for the second ink mark is ejected from the printhead at the same print ejection position used for the first ink mark plus an offset distance (if any). An optical scan of at least a portion of the print medium is generated using a non-printhead-carrier-mounted optical scanner. The distance between the ink marks is measured using the optical scan. The ink drop velocity is calculated using the measured distance, the offset distance, the first and second printhead velocities, and the gap.

20 Claims, 3 Drawing Sheets

METHOD FOR DETERMINING INK DROP VELOCITY OF CARRIER-MOUNTED PRINTHEAD USING AN OPTICAL SCANNER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to printing, and more particularly to a method for determining the ink drop velocity of a carrier-mounted printhead.

2. Description of the Related Art

Known printers include a printer, such as an inkjet printer, having a carrier-mounted printhead with print nozzles used to print ink on a print medium. The printhead carrier moves the printhead back and forth along a printhead-carrier-scanning axis at a gap above the print medium. Printing may be from left to right, from right to left or bidirectional (i.e., from left to right and from right to left). The print medium is advanced in a direction perpendicular to the printhead-carrier-scanning axis when the printhead has finished printing a scan line in one or more print passes. Printer also include all-in-one or multifunction machines adapted to function as at least two different devices, wherein a list of different devices includes a printer (such as an inkjet printer), a copier, a scanner (also called an optical scanner), a facsimile device, and a photo card reader.

The printhead is fired with enough energy to eject ink from the print nozzles at an ink drop velocity (defined to be the ink drop velocity relative to the printhead) having a direction along the ink ejection direction from the printhead to the print medium and having a magnitude typically in the range of 250 to 700 ips (inches per second) with 400 ips being an average number for a typical inkjet printer. From printhead lot to printhead lot, there are substantial variations in the amount of energy needed to attain this magnitude of the ink drop velocity. During printing, the ink drop velocity is assumed to have a particular magnitude. This assumed magnitude of the ink drop velocity is used to determine where the ink drop will land on the print medium if fired from a printhead having a gap between the printhead and the print medium and a known printhead carrier velocity.

This assumed magnitude of the ink drop velocity is often wrong. The effect is that ink drops do not land exactly where intended. It does not matter if the actual magnitude of the velocity is greater or less than the assumed magnitude; the net effect is still the same. Known printhead alignment procedures can compensate for some of this variation, but if the actual magnitude of the ink drop velocity could be determined, print quality could be enhanced. Known techniques for determining the ink drop velocity include measuring the time it takes for the ink drop to pass between two optical drop sensors spaced a distance apart above the print medium. What is needed is an improved method for determining the ink drop velocity of a carrier-mounted printhead.

SUMMARY OF THE INVENTION

A first method of the invention is for determining the ink drop velocity of a carrier-mounted printhead located at a gap above a print medium and includes steps a) through e). Step a) includes printing a first ink mark on the print medium using the printhead with the printhead carrier moving along a printhead-carrier-scanning axis at a first printhead velocity. The printhead begins ejecting ink corresponding to the first ink mark at an ink-ejection position along the printhead-carrier-scanning axis. Step b) includes printing a second ink mark on the print medium using the printhead with the printhead carrier moving along the printhead-carrier-scanning axis at a second printhead velocity which is different from the first printhead velocity. The printhead begins ejecting ink corresponding to the second ink mark at the ink-ejection position plus an offset distance, and the second ink mark is spaced apart from the first ink mark. Step c) includes generating an optical scan of at least a portion of the print medium using a non-printhead-carrier-mounted optical scanner. Step d) includes measuring the distance between the first and second ink marks using the optical scan. Step e) includes calculating the ink drop velocity using the measured distance, the offset distance, the first and second printhead velocities, and the gap.

A second method of the invention is for determining the ink drop velocity of a carrier-mounted printhead located at a gap above a print medium and includes steps a) through e). Step a) includes printing a first pattern of first ink marks on the print medium using the printhead with the printhead carrier moving along a printhead-carrier-scanning axis at a first printhead velocity. The printhead begins ejecting ink corresponding to the first ink marks at equally-spaced-apart ink-ejection positions along the printhead-carrier-scanning axis. Step b) includes printing a second pattern of second ink marks on the print medium using the printhead with the printhead carrier moving along the printhead-carrier-scanning axis at a second printhead velocity which is different from the first printhead velocity. The printhead begins ejecting ink corresponding to the second ink marks at the ink-ejection positions plus an offset distance, and the second ink marks are spaced apart from, and interleaved with, the first ink marks. Step c) includes generating an optical scan of at least a portion of the print medium using a non-printhead-carrier-mounted optical scanner. Step d) includes measuring the distance between adjacent and ink-ejection-position-corresponding first and second ink marks using the optical scan. Step e) includes calculating the ink drop velocity using the measured distance, the offset distance, the first and second printhead velocities, and the gap.

A third method of the invention is for determining the ink drop velocity of a carrier-mounted printhead located at a gap above a print medium, wherein the printhead is a printhead of a printer of an all-in-one machine which also includes a print-medium exit tray and an optical scanner. The third method includes steps a) through g). Step a) includes printing a first ink mark on the print medium using the printhead with the printhead carrier moving along a printhead-carrier-scanning axis at a first printhead velocity. The printhead begins ejecting ink corresponding to the first ink mark at an ink-ejection position along the printhead-carrier-scanning axis. Step b) includes printing a second ink mark on the print medium using the printhead with the printhead carrier moving along the printhead-carrier-scanning axis at a second printhead velocity which is different from the first printhead velocity. The printhead begins ejecting ink corresponding to the second ink mark at the ink-ejection position plus an offset distance, and the second ink mark is spaced apart from the first ink mark Step c) includes, after steps a) and b), ejecting the print medium to the print-medium exit tray. Step d) includes directing a user to place the print medium on or in the optical scanner. Step e) includes generating an optical scan of at least a portion of the print medium using the optical scanner. Step f) includes measuring the distance between the first and second ink marks using the optical scan. Step g) includes calculating the ink drop velocity using the measured distance, the offset distance, the first and second printhead velocities, and the gap.

Several benefits and advantages are derived from one or more of the methods of the invention. Measuring ink drop velocity will insure high quality printing with a more accurate placement of the ink drops on the print medium. Using a non-printhead-carrier-mounted optical scanner to generate an optical scan of at least a portion of the print medium, wherein the optical scan is used in the distance measuring step, avoids the cost of adding a printhead-carrier-mounted optical sensor in setups having a printer and an optical scanner such as, for example, in an all-in-one machine adapted to function as a printer and as an optical scanner. In one application, more accurately determining ink drop velocity allows the designer to optimize the ink-jet firing energy to reduce the heat generated in the printhead.

DETAILED DESCRIPTION

Figure 1:
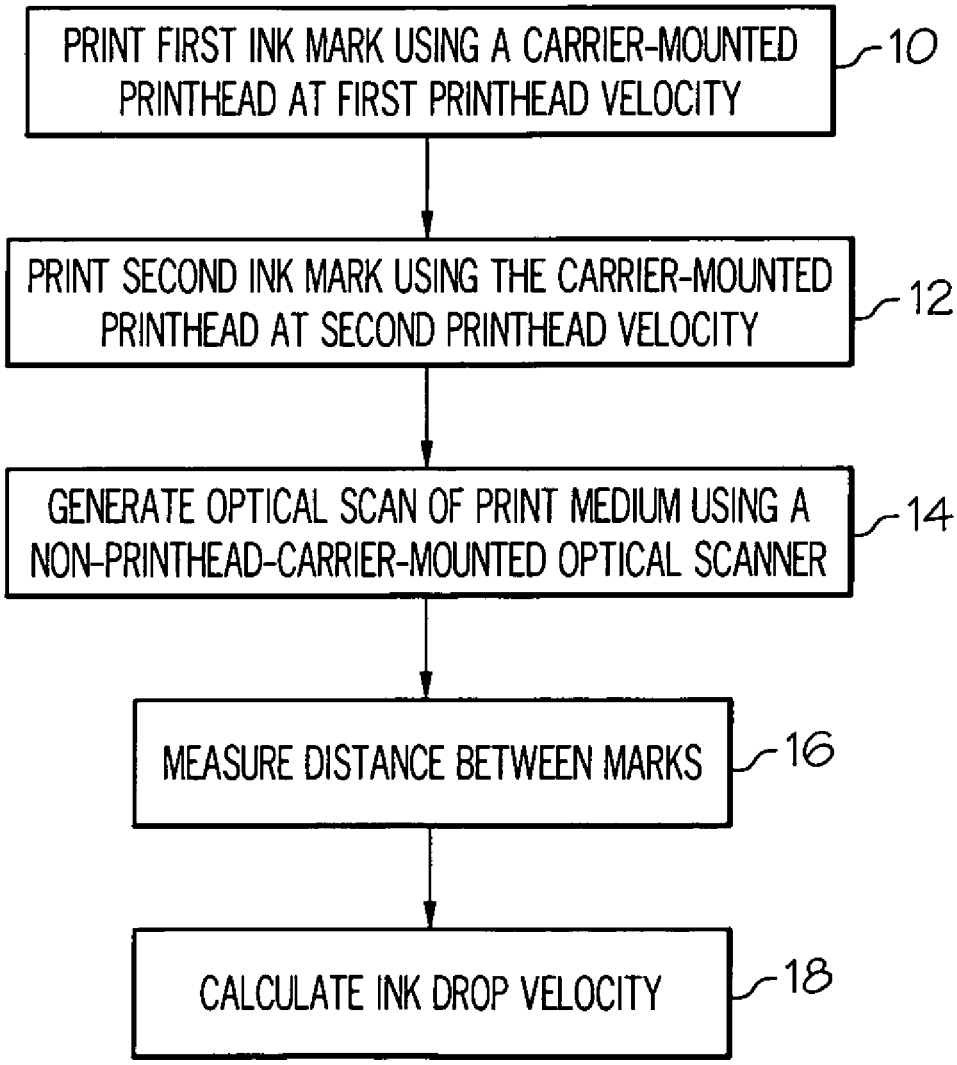
FIG. 1 is a block diagram of a first method of the invention.

A first method of the invention is for determining the ink drop velocity of a carrier-mounted printhead disposed at a gap above a print medium. Ink drop velocity is defined to be the ink drop velocity relative to the printhead. The first method is shown in block diagram form in FIG. 1 and includes steps a) through e). Step a) is labeled as "Print First Ink Mark At First Printhead Velocity" in block 10 of FIG. 1. Step a) includes printing a first ink mark on the print medium using the printhead with the printhead carrier moving along a printhead-carrier-scanning axis at a first printhead velocity, wherein the printhead begins ejecting ink corresponding to the first ink mark at an ink-ejection position along the printhead-carrier-scanning axis. Step b) is labeled as "Print Second Ink Mark At Second Printhead Velocity" in block 12 of FIG. 1. Step b) includes printing a second ink mark on the print medium using the printhead with the printhead carrier moving along the printhead-carrier-scanning axis at a second printhead velocity which is different from the first printhead velocity, wherein the printhead begins ejecting ink corresponding to the second ink mark at the ink-ejection position plus an offset distance, and wherein the second ink mark is spaced apart from the first ink mark. Step c) is labeled as "Generate Optical Scan of Print Medium" in block 14 of FIG. 1. Step c) includes generating an optical scan of at least a portion of the print medium using a non-printhead-carrier-mounted optical scanner. A "non-printhead-carrier-mounted optical scanner" is an optical scanner which is not mounted on the printhead carrier. Step d) is labeled as "Measure Distance Between Marks" in block 16 of FIG. 1. Step d) includes measuring the distance between the first and second ink marks using the optical scan. Step e) is labeled as "Calculate Ink Drop Velocity" in block 18 of FIG. 1. Step e) includes calculating the ink drop velocity using the measured distance, the offset distance, the first and second printhead velocities, and the gap.

It is noted that the terms "first ink mark" and "second ink mark" in the first method are used merely to distinguish between two ink marks. For example, such terms do not require the first ink mark to have been printed in time before the second ink mark. Also, for example, such terms do not require the first ink mark to have been printed in space as first in position among a line of ink marks. In one embodiment, the ink marks are identical rectangular block ink marks. Other embodiments of identical or non-identical ink marks, including their sizes, shapes, and colors, are left to the artisan. It is also noted that step e) can use additional factors than those listed in calculating the ink drop velocity such as, without limitation, averaging the measured distances between each ink mark of a first set of first ink marks and corresponding adjacent ink marks of a second set of second ink marks, as can be appreciated by those skilled in the art. It is further noted that the gap is a predetermined gap meaning that the gap has been determined (such as, in one example, by being measured) before being needed to perform step e). Likewise, the offset distance is a predetermined offset distance meaning that the offset distance has been determined (such as, in one example, by being chosen by the designer) before being needed to perform step b).

In one implementation of the first method, steps a) and b) are preformed without advancing the print medium between steps a) and b). In a different implementation, the print medium is advanced between steps a) and b), and step d) measures the distance along the printhead-carrier-scanning axis between the first and second ink marks.

In one example of the first method, the optical scanner of step c) is a CIS (contact image sensor) optical scanner. In another example, the optical scanner of step c) is a CCD (charge-coupled device) optical scanner. In one enablement of the first method, the optical scanner has a movable optical-scanner scan bar which moves over (or under) the print medium. In another enablement, the optical scanner has a stationary optical-scanner scan bar over which (or under which) the print medium moves. In one variation, the print medium has a width-wise axis which is disposed substantially parallel to the printhead-carrier-scanning axis during printing of the first and second ink marks in steps a) and b) and which is disposed substantially parallel to the optical-scanner scan bar in step c). In this variation, step d) measures the distance between the first and second ink marks of the optical scan along the optical-scanner scan bar axis. In one illustration, the printhead is a printhead of a printer. In one construction, the printhead is an inkjet printhead of an inkjet printer. Other examples, enablements, variations, illustrations and constructions are left to the artisan.

In one enablement of the first method, the printer and the optical scanner are components of an all-in-one machine. An all-in-one machine is a machine adapted to function as at least two different devices, wherein a list of different devices includes a printer (such as an inkjet printer), a copier, a scanner (also called an optical scanner), a facsimile device, and a photo card reader. In one variation, a user removes the print medium from a print-medium exit tray of the all-in-one machine after steps a) and b) and presents the print medium to the optical scanner of the all-in-one machine before step c). In another variation, the all-in-one machine has a print-medium path adapted to dispose the print medium for printing for steps a) and b) and to present the print medium to the optical scanner for step c). In a different enablement, the printer and the optical scanner are not components of an all-in-one machine. It is noted that measuring distances between print marks of an optical scan is within the routine capabilities of those skilled in the art.

In one arrangement of the first method, the printer and the optical scanner are not components of an all-in-one machine and are operatively connected to a host computer which performs steps d) and/or e). In another arrangement, the printer and the optical scanner are components of an all-in-one machine which performs steps d) and/or e). In a further arrangement, the printer and the optical scanner are components of an all-in-one machine which is operatively connected to a host computer which performs steps d) and/or e). Other arrangements are left to the artisan. In one variation, the printer and/or the all-in-one machine does not have a printhead-carrier-mounted optical sensor such as a printhead-carrier-mounted optical reflective sensor such as a printhead-carrier-mounted printhead auto-alignment sensor.

It is noted that temporarily disabling any ink-drop-velocity corrections implemented within the firmware of the printer controller during the performance of the first method will improve the accuracy of the method in determining the ink drop velocity. Such disabled corrections include any alignment and/or timing adjustments used to correct ink drop placement. When the ink drop velocity has been measured by the method, it can be used as a reference velocity for automatic ink drop velocity adjustment as can be appreciated by the artisan. In one enablement, the first method is repeated for different energy levels of the printhead to produce a curve, of drop velocities at given printhead energy levels, from which an optimal energy level can be selected and stored in the printer or in the all-in-one machine for normal use.

A velocity has a magnitude (speed) and a direction. The direction of the ink drop velocity is along the ink ejection direction from the printhead to the print medium. In one enablement of the first method, the first printhead velocity has a first magnitude and a first direction along the printhead-carrier-scanning axis, and the second printhead velocity has a second magnitude and a second direction along the printhead-carrier-scanning axis.

In a first variation, the second magnitude is different from the first magnitude, and the second direction is identical to the first direction. One illustration of the first variation is having the first ink mark printed from left to right at a slower quality-mode printhead carrier speed and having the second ink mark printed from left to right at a faster draft-mode printhead carrier speed. In a second variation, the second magnitude is different from the first magnitude, and the second direction is opposite to the first direction. One illustration of the second variation is having the first ink mark printed from left to right at a slower quality-mode printhead carrier speed and having the second ink mark printed from right to left at a faster draft-mode printhead carrier speed.

In a third variation, the second magnitude is identical to the first magnitude, and the second direction is opposite to the first direction. In one modification of the third variation, the first magnitude is equal to the maximum speed of the printhead carrier. One illustration of this modification is having the first ink mark printed from left to right at the maximum printhead carrier speed and having the second ink mark printed from right to left at the same maximum printhead carrier speed. This illustration results in the greatest distance between the first and second ink marks. This results in the greatest accuracy for determining the ink drop velocity, when the distance measurement measures in finite increments, as can be appreciated by those skilled in the art.

In one application of the first method, the offset distance is zero. In a different application of the first method, the offset distance is a finite distance chosen for proper spacing apart of the first and second ink marks, as is within the ordinary level of skill of the artisan. In one use of the first method, the first and second ink marks each have a substantially identically rectangular block shape. Examples of other ink mark shapes are left to the artisan as is the use of a second ink mark which is different in size and/or shape from the first ink mark.

One equation is $V=d(CV2-CV1)/(Ym-Yp)$ for use in step e) of the first method. In this equation: V is the magnitude of the ink drop velocity; d is the gap between the printhead and the print medium; CV2 is the second velocity of the printhead; CV1 is the first velocity of the printhead; Ym is the measured distance between the adjacent and ink-ejection-position-corresponding first and second ink marks; and Yp is the offset distance. In this equation: CV2 is larger in magnitude than CV1; CV2 is defined to be a positive number; and CV1 is defined to be a positive number if the printhead carrier moved in the same direction for the printing of the first and second ink marks and is defined to be a negative number if the printhead carrier moved in opposite directions for the printing of the first and second ink marks. Ym is defined to be a positive number. Yp is defined to be a positive number if the first printhead velocity, the second printhead velocity and the offset are all in the same direction or if the second printhead velocity and the offset are in the same direction opposite to the direction of the first printhead velocity. Otherwise, Yp is defined to be a negative number. In one usage of the first method, Yp is zero. In another usage of the first method, Yp is nonzero such as, in one example, when extra spacing is needed to separate the first and second ink marks. Other equations for use in step e) are left to the artisan.

In one execution of the first method, a printhead-carrier position encoder is used to signal that the ink ejection position in steps a) and b) has been reached for the printhead to print the first and second ink marks Other techniques for locating the ink ejection position are left to the artisan.

Figure 2:
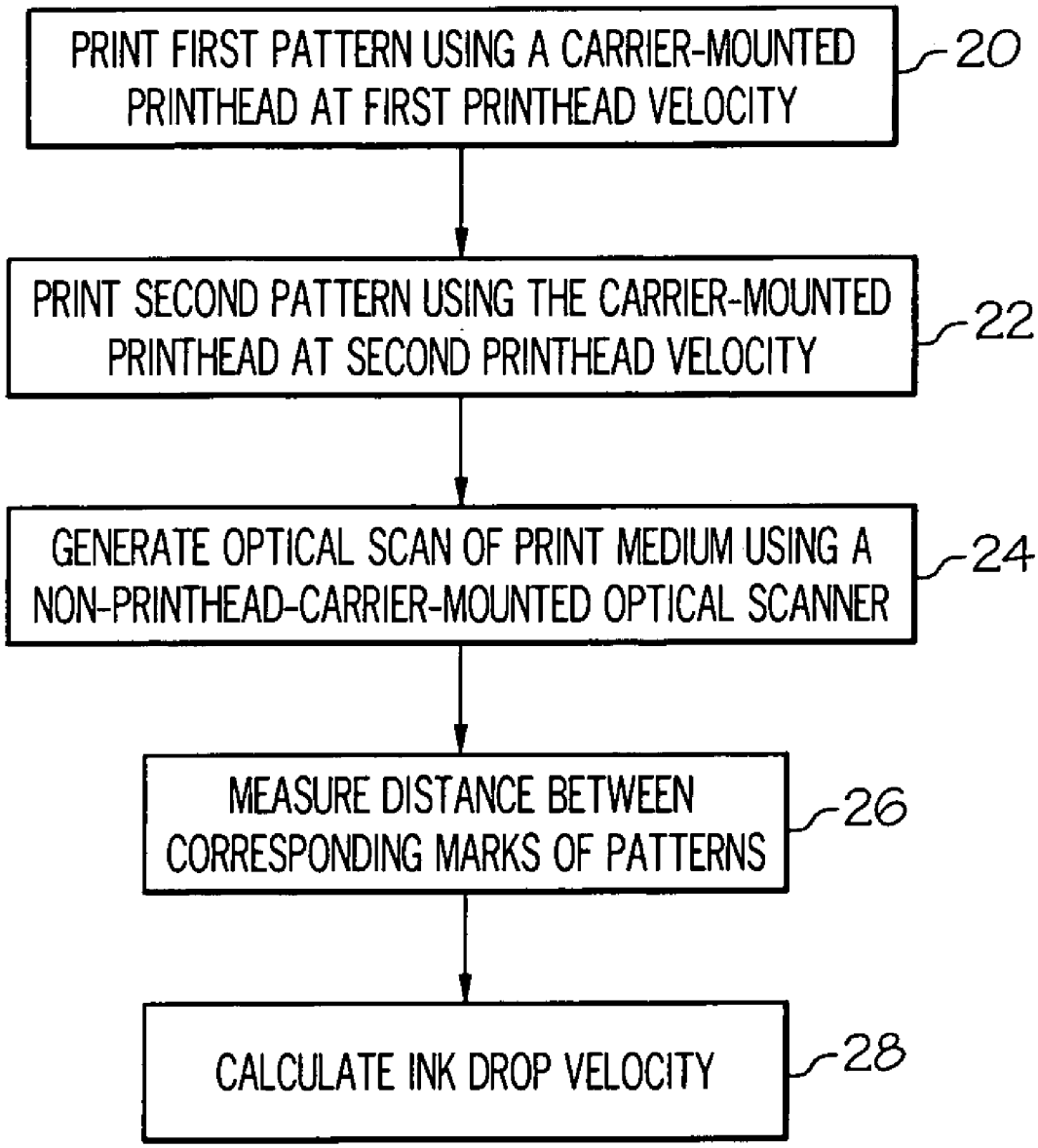
FIG. 2 is a block diagram of a second method of the invention.

A second method of the invention is for determining the ink drop velocity of a carrier-mounted printhead disposed at a gap above a print medium. The second method is shown in block diagram form in FIG. 2 and includes steps a) through e). Step a) is labeled as "Print First Pattern At First Printhead Velocity" in block 20 of FIG. 2. Step a) includes printing a first pattern of first ink marks on the print medium using the printhead with the printhead carrier moving along a printhead-carrier-scanning axis at a first printhead velocity, wherein the printhead begins ejecting ink corresponding to the first ink marks at equally-spaced-apart ink-ejection positions along the printhead-carrier-scanning axis. Step b) is labeled as "Print Second Pattern At Second Printhead Velocity" in block 22 of FIG. 2. Step b) includes printing a second pattern of second ink marks on the print medium using the printhead with the printhead carrier moving along the printhead-carrier-scanning axis at a second printhead velocity which is different from the first printhead velocity, wherein the printhead begins ejecting ink corresponding to the second ink marks at the ink-ejection positions plus an offset distance, and wherein the second ink marks are spaced apart from, and interleaved with, the first ink marks. It is noted that the terms "first ink marks" and "second ink marks" in the second method are used merely to distinguish between two patterns of ink marks. Step c) is labeled as "Generate Optical Scan of Print Medium" in block 24 of FIG. 2. Step c) includes generating an optical scan of at least a portion of the print medium using a non-printhead-carrier-mounted optical scanner. Step d) is labeled as "Measure Distance Between Corresponding Marks Of Patterns" in block 26 of FIG. 2. Step d) includes measuring the distance between adjacent and ink-ejection-position-corresponding first and second ink marks using the optical scan. Step e) is labeled as "Calculate Ink Drop Velocity" in block 28 of FIG. 2. Step e) includes calculating the ink drop velocity using the measured distance, the offset distance, the first and second printhead velocities, and the gap. Appropriate implementations, examples, enablements, arrangements, etc. of the first method are applicable as implementations, examples, enablements, arrangements, etc. of the second method as can be appreciated by the artisan.

In one example of the second method, the first printhead velocity has a first magnitude and a first direction along the printhead-carrier-scanning axis, and the second printhead velocity has a second magnitude and a second direction along the printhead-carrier-scanning axis. In this example, the second magnitude is identical to the first magnitude, and the second direction is opposite to the first direction. In one variation, the first magnitude is equal to the maximum speed of the printhead carrier.

It is noted that measurement accuracy in step d) is increased by using known averaging techniques when the first pattern includes more than one first mark and the second pattern includes more than one second mark, as can be appreciated by those skilled in the art.

One equation is $V=d(2Vm)/(Ym-Yp)$ for use in step e) of the second method when the first and second printhead velocities have opposite directions and have equal magnitudes equal to the maximum speed of the printhead carrier. In this equation: V is the magnitude of the ink drop velocity; d is the gap between the printhead and the print medium; Vm is the maximum speed of the printhead carrier, Ym is the measured distance between the adjacent and ink-ejection-position-corresponding first and second ink marks; and Yp is the offset distance. Vm and Ym are defined to be positive numbers. Yp is defined to be a positive number if the second printhead velocity and the offset have the same direction and is defined to be a negative number if the second printhead velocity and the offset have opposite directions. In one usage of the second method, Yp is zero. In another usage of the second method, Yp is nonzero such as, in one example, when extra spacing is needed to separate the first and second ink marks. Other equations are left to the artisan. In one variation, the first and second ink marks each have a substantially identically rectangular block shape.

In one enablement of the second method, the printhead is an inkjet printhead of an inkjet printer, and the printer and the optical scanner are components of an all-in-one machine.

A third method of the invention is for determining the ink drop velocity of a carrier-mounted printhead disposed at a gap above a print medium, wherein the printhead is a printhead of a printer of an all-in-one machine which also includes a print-medium exit tray and an optical scanner.

Figure 3:
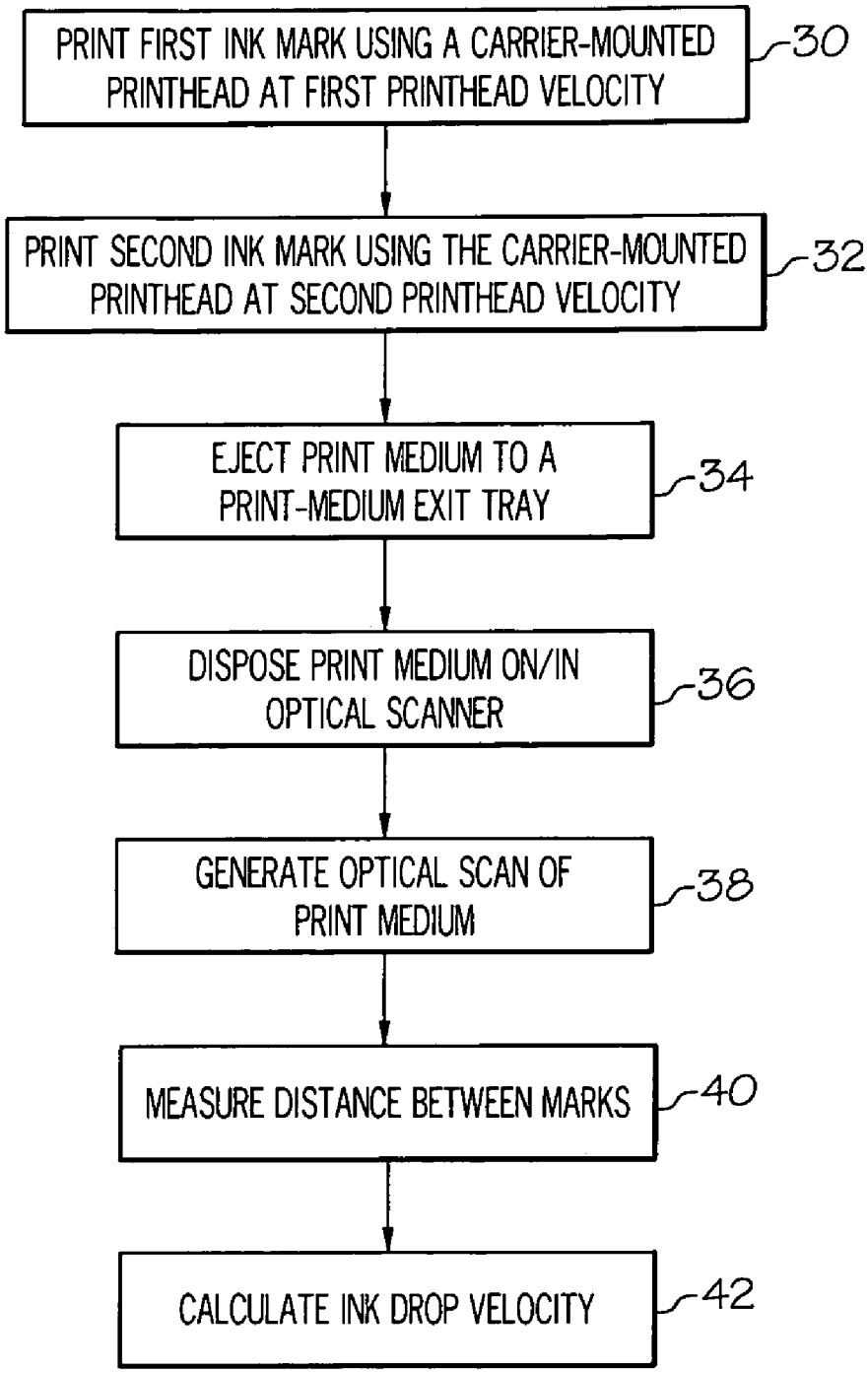
FIG. 3 is a block diagram of a third method of the invention.

The third method is shown in block diagram form in FIG. 3 and includes steps a) through g). Step a) is labeled as "Print First Ink Mark At First Printhead Velocity" in block 30 of FIG. 3. Step a) includes printing a first ink mark on the print medium using the printhead with the printhead carrier moving along a printhead-carrier-scanning axis at a first printhead velocity, wherein the printhead begins ejecting ink corresponding to the first ink mark at an ink-ejection position along the printhead-carrier-scanning axis. Step b) is labeled as "Print Second Ink Mark At Second Printhead Velocity" in block 32 of FIG. 3. Step b) includes printing a second ink mark on the print medium using the printhead with the printhead carrier moving along the printhead-carrier-scanning axis at a second printhead velocity which is different from the first printhead velocity, wherein the printhead begins ejecting ink corresponding to the second ink mark at the ink-ejection position plus an offset distance, and wherein the second ink mark is spaced apart from the first ink mark. Step c) is labeled as "Eject Print Medium" in block 34 of FIG. 3. Step c) includes, after steps a) and b), ejecting the print medium to the print-medium exit tray. Step d) is labeled as "Dispose Print Medium On/In Optical Scanner" in block 36 of FIG. 3. Step d) includes directing a user to dispose the print medium on or in the optical scanner. Step e) is labeled as "Generate Optical Scan of Print Medium" in block 38 of FIG. 3. Step e) includes generating an optical scan of at least a portion of the print medium using the optical scanner. Step f) is labeled as "Measure Distance Between Marks" in block 40 of FIG. 3. Step f) includes measuring the distance between the first and second ink marks using the optical scan. Step g) is labeled as "Calculate Ink Drop Velocity" in block 42 of FIG. 3. Step g) includes calculating the ink drop velocity using the measured distance, the offset distance, the first and second printhead velocities, and the gap.

Appropriate implementations, examples, enablements, arrangements, etc. of the first and/or second methods are applicable as implementations, examples, enablements, arrangements, etc. of the third method as can be appreciated by the artisan.

Several benefits and advantages are derived from one or more of the methods of the invention. Measuring ink drop velocity will insure high quality printing with a more accurate placement of the ink drops on the print medium. Using a non-printhead-carrier-mounted optical scanner to generate an optical scan of at least a portion of the print medium, wherein the optical scan is used in the distance measuring step, avoids the cost of adding a printhead-carrier-mounted optical sensor in setups having a printer and an optical scanner such as, for example, in an all-in-one machine adapted to function as a printer and as an optical scanner. In one application, more accurately determining ink drop velocity allows the designer to optimize the ink-jet firing energy to reduce the heat generated in the printhead.

The foregoing description of several methods of the invention has been presented for purposes of illustration. It is not intended to be exhaustive or to limit the invention to the precise procedures disclosed, and obviously many modifications and variations are possible in light of the above teaching. It is intended that the scope of the invention be defined by the claims appended hereto.

What is claimed is:

1. A method for determining the ink drop velocity of a carrier-mounted printhead disposed at a gap above a print medium comprising the steps of:

a) printing a first ink mark on the print medium using the printhead with the printhead carrier moving along a printhead-carrier-scanning axis at a first printhead velocity, wherein the printhead begins ejecting ink corresponding to the first ink mark at an ink-ejection position along the printhead-carrier-scanning axis;

b) printing a second ink mark on the print medium using the printhead with the printhead carrier moving along the printhead-carrier-scanning axis at a second printhead velocity which is different from the first printhead velocity, wherein the printhead begins ejecting ink corresponding to the second ink mark at the ink-ejection position plus an offset distance, and wherein the second ink mark is spaced apart from the first ink mark;

c) generating an optical scan of at least a portion of the print medium using a non-printhead-carrier-mounted optical scanner;

d) measuring the distance between the first and second ink marks using the optical scan; and e) calculating the ink drop velocity using the measured distance, the offset distance, the first and second printhead velocities, and the gap.

2. The method of claim 1, wherein steps a) and b) are performed without advancing the print medium between steps a) and b).

3. The method of claim 1, wherein the printhead is an inkjet printhead of an inkjet printer.

4. The method of claim 3, wherein the inkjet printer and the optical scanner are components of an all-in-one machine.

5. The method of claim 1, wherein the first printhead velocity has a first magnitude and a first direction along the printhead-carrier-scanning axis, and wherein the second printhead velocity has a second magnitude and a second direction along the printhead-carrier-scanning axis.

6. The method of claim 5, wherein the second magnitude is different from the first magnitude.

7. The method of claim 6, wherein the second direction is identical to the first direction.

8. The method of claim 6, wherein the second direction is opposite to the first direction.

9. The method of claim 5, wherein the second magnitude is identical to the first magnitude, and wherein the second direction is opposite to the first direction.

10. The method of claim 9, wherein the first magnitude is equal to the maximum speed of the printhead carrier.

11. The method of claim 1, wherein the offset distance is zero.

12. The method of claim 1, wherein the first and second ink marks each have a substantially identically rectangular block shape.

13. The method of claim 1, wherein step e) calculates the ink drop velocity magnitude V using the equation $V=d(CV2-CV1)/(Ym-Yp)$, wherein d is the gap between the printhead and the print medium, CV2 is the second printhead velocity, CV1 is the first printhead velocity, Ym is the measured distance between the adjacent and ink-ejection-position-corresponding first and second ink marks, and Yp is the offset distance, wherein CV2 is larger in magnitude than CV1, wherein CV2 is defined to be a positive number, and wherein CV1 is defined to be a positive number if the printhead carrier moved in the same direction for the printing of the first and second ink marks and is defined to be a negative number if the printhead carrier moved in opposite directions for the printing of the first and second ink marks.

14. A method for determining the ink drop velocity of a carrier-mounted printhead disposed at a gap above a print medium comprising the steps of:

a) printing a first pattern of first ink marks on the print medium using the printhead with the printhead carrier moving along a printhead-carrier-scanning axis at a first printhead velocity, wherein the printhead begins ejecting ink corresponding to the first ink marks at equally-spaced-apart ink-ejection positions along the printhead-carrier-scanning axis;

b) printing a second pattern of second ink marks on the print medium using the printhead with the printhead carrier moving along the printhead-carrier-scanning axis at a second printhead velocity which is different from the first printhead velocity, wherein the printhead begins ejecting ink corresponding to the second ink marks at the ink-ejection positions plus an offset distance, and wherein the second ink marks are spaced apart from, and interleaved with, the first ink marks;

c) generating an optical scan of at least a portion of the print medium using a non-printhead-carrier-mounted optical scanner;

d) measuring the distance between adjacent and ink-ejection-position-corresponding first and second ink marks using the optical scan; and e) calculating the ink drop velocity using the measured distance, the offset distance, the first and second printhead velocities, and the gap.

15. The method of claim 14, wherein the first printhead velocity has a first magnitude and a first direction along the printhead-carrier-scanning axis, wherein the second printhead velocity has a second magnitude and a second direction along the printhead-carrier-scanning axis, wherein the second magnitude is identical to the first magnitude, wherein the second direction is opposite to the first direction.

16. The method of claim 15, wherein the first magnitude is equal to the maximum speed of the printhead carrier.

17. The method of claim 16, wherein step e) calculates the ink drop velocity magnitude V using the equation $V=d(2Vm)/(Ym-Yp)$, wherein d is the gap between the printhead and the print medium, Vm is the maximum speed of the printhead carrier, Ym is the measured distance between the adjacent and ink-ejection-position-corresponding first and second ink marks, and Yp is the offset distance.

18. The method of claim 17, wherein the first and second ink marks each have a substantially identically rectangular block shape.

19. The method of claim 14, wherein the printhead is an inkjet printhead of an inkjet printer, and wherein the inkjet printer and the optical scanner are components of an all-in-one machine.

20. A method for determining the ink drop velocity of a carrier-mounted printhead disposed at a gap above a print medium, wherein the printhead is a printhead of a printer of an all-in-one machine which also includes a print-medium exit tray and an optical scanner, and wherein the method comprises the steps of:

a) printing a first ink mark on the print medium using the printhead with the printhead carrier moving along a printhead-carrier-scanning axis at a first printhead velocity, wherein the printhead begins ejecting ink corresponding to the first ink mark at an ink-ejection position along the printhead-carrier-scanning axis;

b) printing a second ink mark on the print medium using the printhead with the printhead carrier moving along the printhead-carrier-scanning axis at a second printhead velocity which is different from the first printhead velocity, wherein the printhead begins ejecting ink corresponding to the second ink mark at the ink-ejection position plus an offset distance, and wherein the second ink mark is spaced apart from the first ink mark;

c) after steps a) and b), ejecting the print medium to the print-medium exit tray;

d) directing a user to dispose the print medium on or in the optical scanner;

e) generating an optical scan of at least a portion of the print medium using the optical scanner;

f) measuring the distance between the first and second ink marks using the optical scan; and g) calculating the ink drop velocity using the measured distance, the offset distance, the first and second printhead velocities, and the gap.

* * * * *